US011072882B2

(12) United States Patent
James

(10) Patent No.: US 11,072,882 B2
(45) Date of Patent: Jul. 27, 2021

(54) UNIVERSAL PEDESTAL FOR A LAUNDRY APPLIANCE

(71) Applicant: Haier US Appliance Solutions, Inc., Wilmington, DE (US)

(72) Inventor: Alexander Daniel James, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 50 days.

(21) Appl. No.: 16/511,044

(22) Filed: Jul. 15, 2019

(65) Prior Publication Data

US 2021/0017692 A1 Jan. 21, 2021

(51) Int. Cl.
*D06F 39/12* (2006.01)

(52) U.S. Cl.
CPC ..... *D06F 39/125* (2013.01)

(58) Field of Classification Search
CPC ..... D06F 39/125
See application file for complete search history.

(56) References Cited

U.S. PATENT DOCUMENTS

| | | | | |
|---|---|---|---|---|
| 5,971,174 | A * | 10/1999 | Strock | A47B 87/008 211/186 |
| 6,427,966 | B1 * | 8/2002 | Blumenschein | A47B 91/005 248/646 |
| 6,923,419 | B2 * | 8/2005 | George | A47B 91/005 248/188.4 |
| 7,748,682 | B2 | 7/2010 | Hunke et al. | |
| 7,921,679 | B2 | 4/2011 | Jo | |
| 9,255,356 | B2 | 2/2016 | Cheon et al. | |
| 9,447,841 | B2 * | 9/2016 | Kim | F16F 15/08 |
| 2009/0167129 | A1 | 7/2009 | Cho | |

FOREIGN PATENT DOCUMENTS

KR 100776601 B1 11/2007

* cited by examiner

*Primary Examiner* — Anita M King
(74) *Attorney, Agent, or Firm* — Dority & Manning, P.A.

(57) ABSTRACT

A laundry appliance system includes a universal pedestal configured for receiving a raising a washing machine appliance or a dryer. Specifically, the pedestal includes a top side defining a first set of receiving pockets configured for receiving a set of washer leveling legs, and an opposite bottom side defining a second set of receiving pockets configured for receiving a set of dryer leveling legs. Riser leveling legs may be mounted to either side of the pedestal using identical mounting brackets.

20 Claims, 9 Drawing Sheets

UNIVERSAL PEDESTAL FOR A LAUNDRY APPLIANCE

FIELD OF THE INVENTION

The present subject matter relates generally to laundry appliances, and more particularly to pedestals for use with laundry appliances.

BACKGROUND OF THE INVENTION

Laundry appliances, such as washing machine appliances and dryer appliances, typically include an external apron or cabinet that acts as a frame for supporting various components of the appliance and a housing that provides a clean look and prevents a user from contacting internal components. Notably, during operation of both washing machines and dryers, moving components may generate vibrations that can cause excessive noise or even appliance damage if not mitigated. For example, washing machines include wash tubs and dryers include wash baskets, both of which spin at high speeds to facilitate the washing, rinsing, and drying of clothes. One manner of preventing harmful noise and vibrations includes mounting the cabinets on leveling legs that may be raised or lowering to provide a solid base and proper balance of an appliance, thereby minimizing vibrations and out-of-balance conditions.

Certain conventional laundry machine appliance are mounted on pedestals, e.g., to provide extra storage below the appliance as well as provide access to the appliance without bending over. These pedestals typically include dedicated leveling legs to facilitate the support of appliances in a manner similar to the appliance leveling legs. Notably, due to differences between the size, position, and type of feet used for washing machines and dryers, prior pedestals have been configured for receipt of only a specific type and model of appliance. For example, a consumer would need to buy a washing machine pedestal compatible with their particular washing machine model and a dryer pedestal compatible with their particular dryer model. In addition, the manufacturing of a unique pedestal for each model/type of an appliance is costly and inefficient for manufacturers, e.g., due to tooling requirement, parts requirements, etc.

Accordingly, a laundry appliance system with improved pedestals would be useful. More specifically, a pedestal that may be easily installed and is compatible with both washing machine appliances and dryer appliances would be particularly beneficial.

BRIEF DESCRIPTION OF THE INVENTION

Aspects and advantages of the invention will be set forth in part in the following description, or may be obvious from the description, or may be learned through practice of the invention.

In one aspect of the present disclosure, a riser assembly for receiving a washing machine or a dryer is provided. The riser assembly includes a pedestal having a top side defining a first set of receiving pockets configured for receiving a set of washer leveling legs and an opposite bottom side defining a second set of receiving pockets configured for receiving a set of dryer leveling legs.

In another aspect of the present disclosure, a laundry appliance system is provided including a washing machine includes a washer cabinet and set of washer leveling legs extending from a bottom of the washer cabinet, a dryer includes a dryer cabinet and a set of dryer leveling legs extending from a bottom of the dryer cabinet, and a riser assembly for receiving the washing machine or the dryer. The riser assembly includes a pedestal having a top side defining a first set of receiving pockets configured for receiving the set of washer leveling legs and an opposite bottom side defining a second set of receiving pockets configured for receiving the set of dryer leveling legs.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
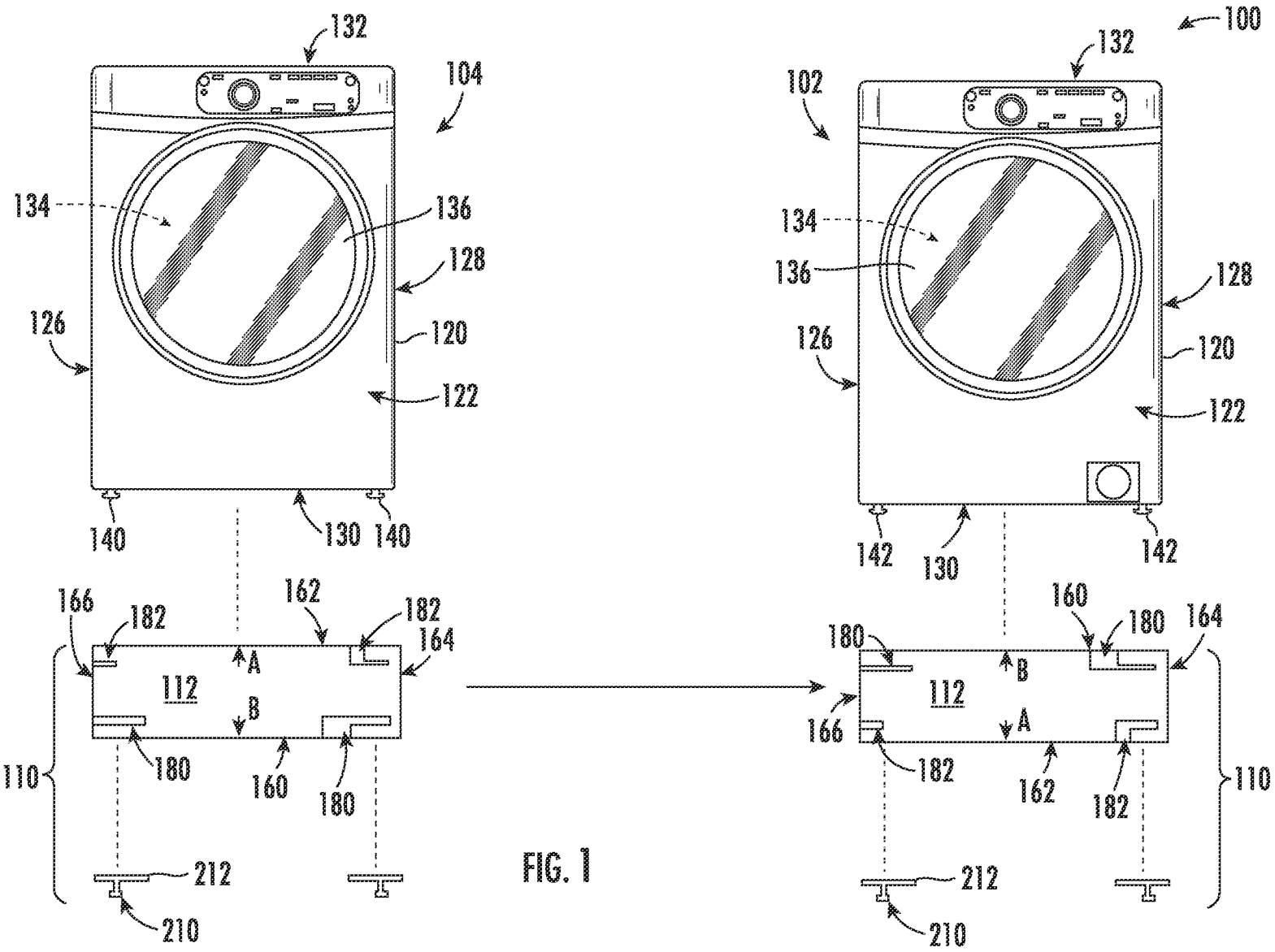
FIG. 1 provides a schematic representation of a laundry appliance system that includes a washing machine, a dryer, and a riser assembly according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates a laundry appliance system 100 according to exemplary embodiments of the present subject matter. As shown, laundry appliance system 100 generally includes a washing machine 102 and a dryer appliance 104, for washing and drying clothes, respectively. In addition, laundry appliance system 100 may include one or more riser assemblies 110 which generally include a pedestal 112 and are configured for elevating or raising the height of washing machine 102 and/or dryer 104 to a height more convenient for a user or to provide storage space underneath the appliance.

Notably, as explained above, conventional riser pedestals are appliance and/or model specific, thus requiring the consumer to purchase a unique pedestal particularly suited for their appliance. As will be explained in detail below, riser assembly 110 and pedestal 112 are generally designed to facilitate universal use of pedestal 112 for different styles and models of laundry appliances. Moreover, although aspects of the present subject matter are used to describe a pedestal for use with both a washer and dryer appliances, it should be appreciated that according to alternative embodiments, aspects of the present subject matter may be used to raise or support any other suitable appliance or appliance assembly.

Referring now generally to FIGS. 2 through 5, an exemplary appliance which may be used with riser assembly 110 will be described according to an exemplary embodiment. Specifically, these figures illustrate various views of dryer 104 in order to facilitate discussion regarding the use and operation of riser assembly 110. However, it should be appreciated that washing machine 102 or any other suitable appliance may interact or connect with riser assembly 110 in the same or similar manner as described relative to dryer 104. Indeed, like reference numerals will be used to refer to the same or similar features between washing machine 102 and dryer 104. It should be further appreciated that the present subject matter is not limited to the style or configuration of the appliances described herein.

Figure 2:
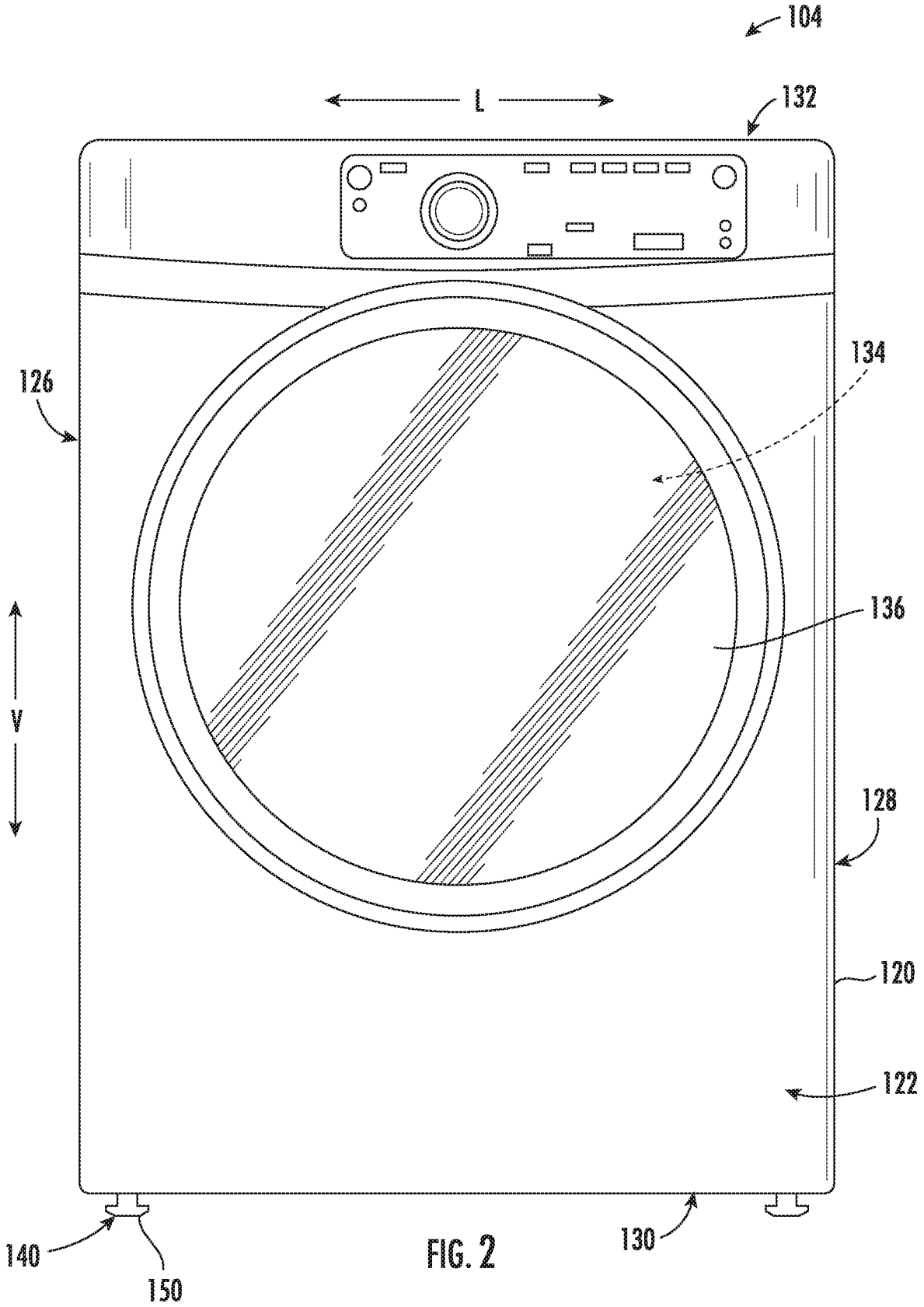
FIG. 2 provides a front view of the exemplary dryer appliance of FIG. 1.
Figure 3:
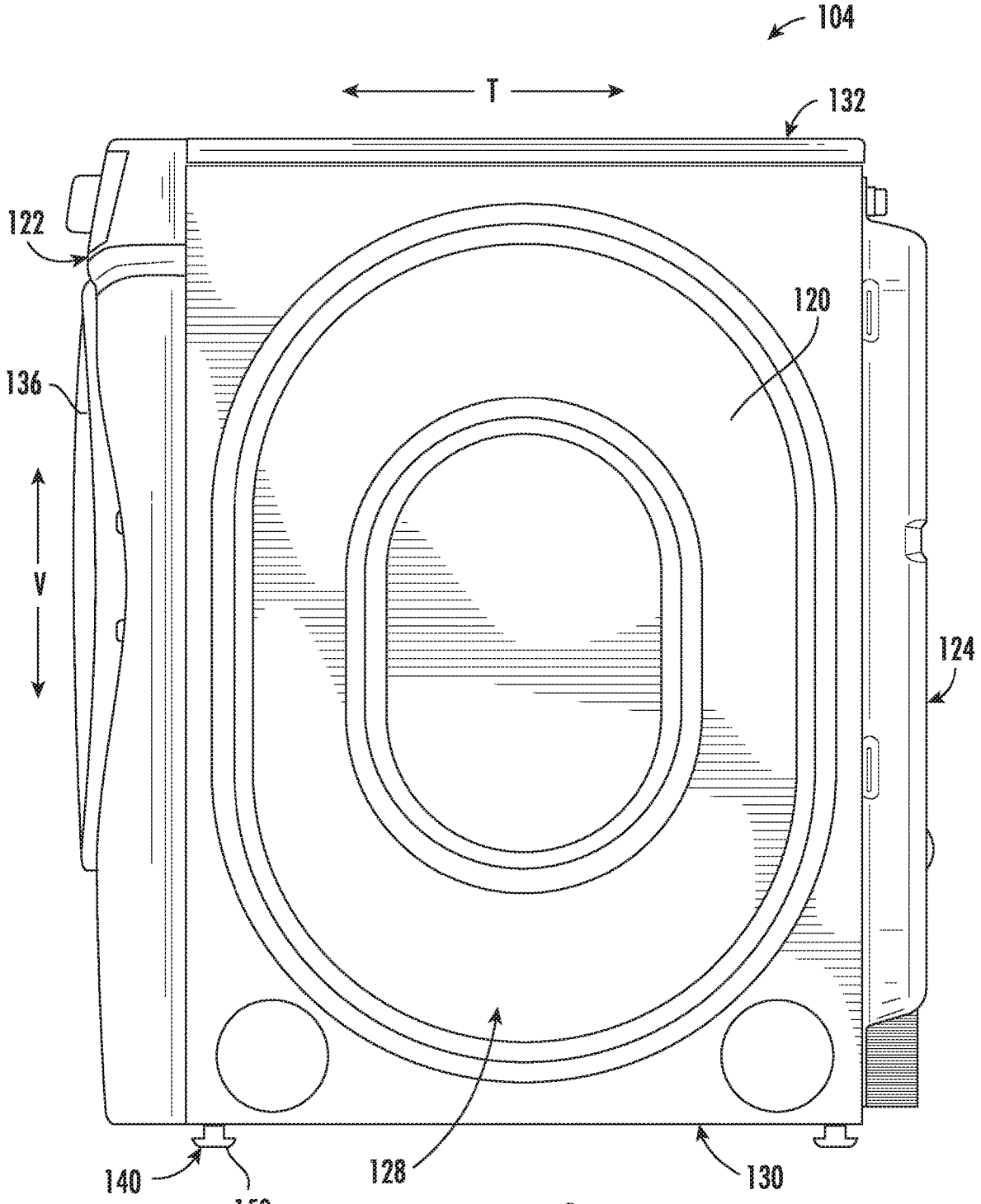
FIG. 3 provides a side view of the exemplary dryer appliance of FIG. 1.
Figure 4:
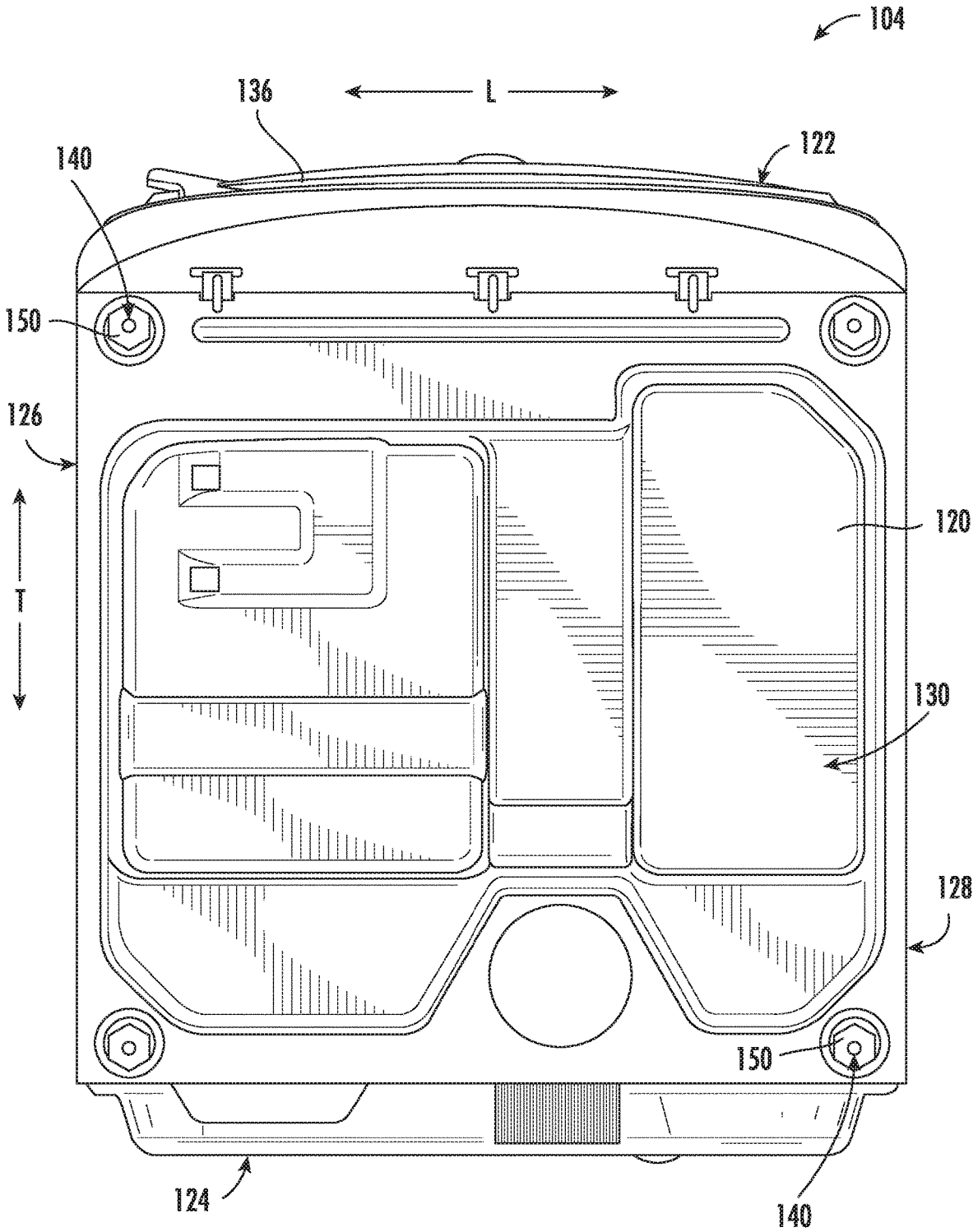
FIG. 4 provides a bottom view of the exemplary dryer appliance of FIG. 1.
Figure 5:
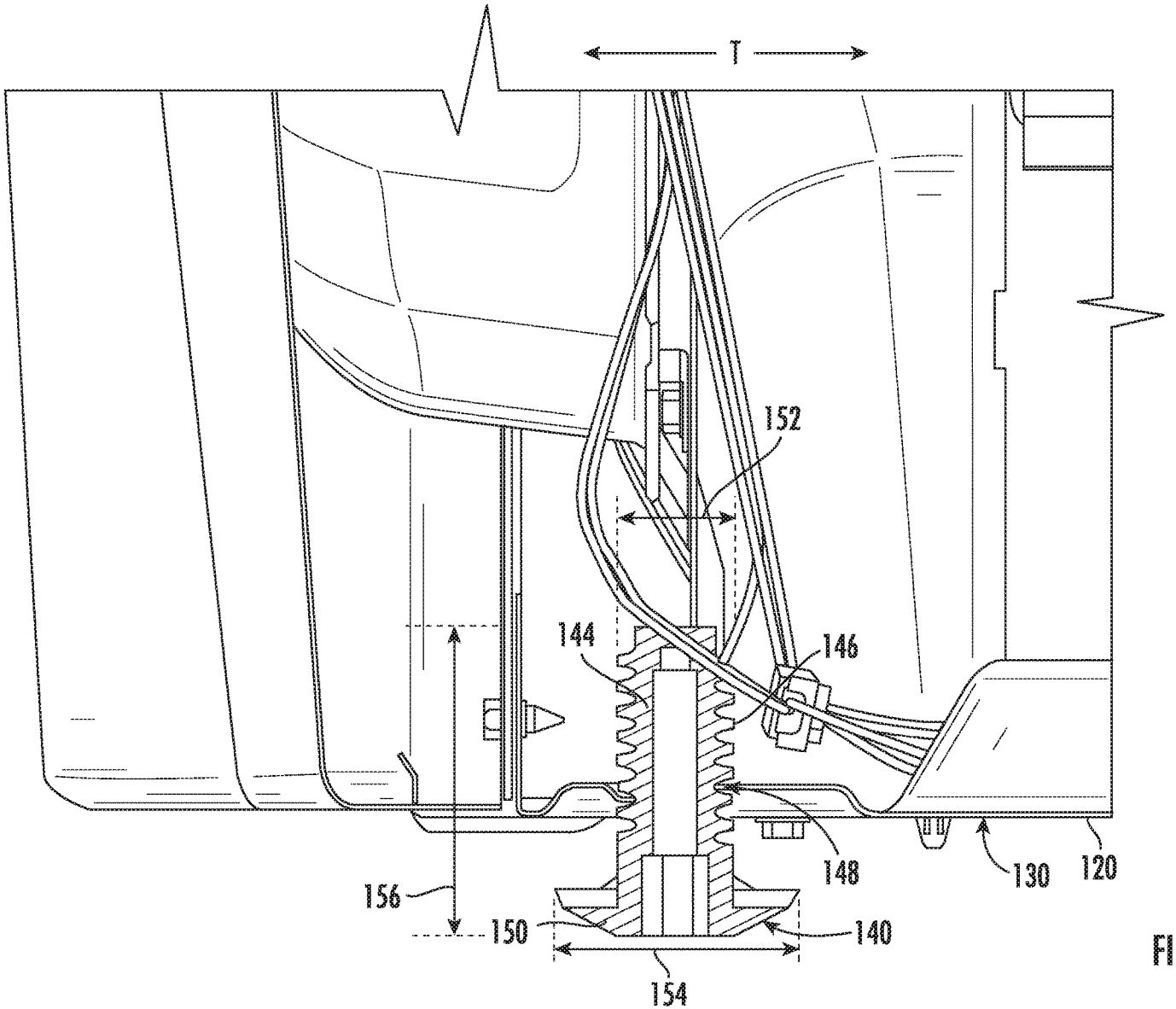
FIG. 5 provides a close up cross sectional view of a set of dryer leveling legs of the exemplary dryer appliance of FIG. 1.
Figure 6:
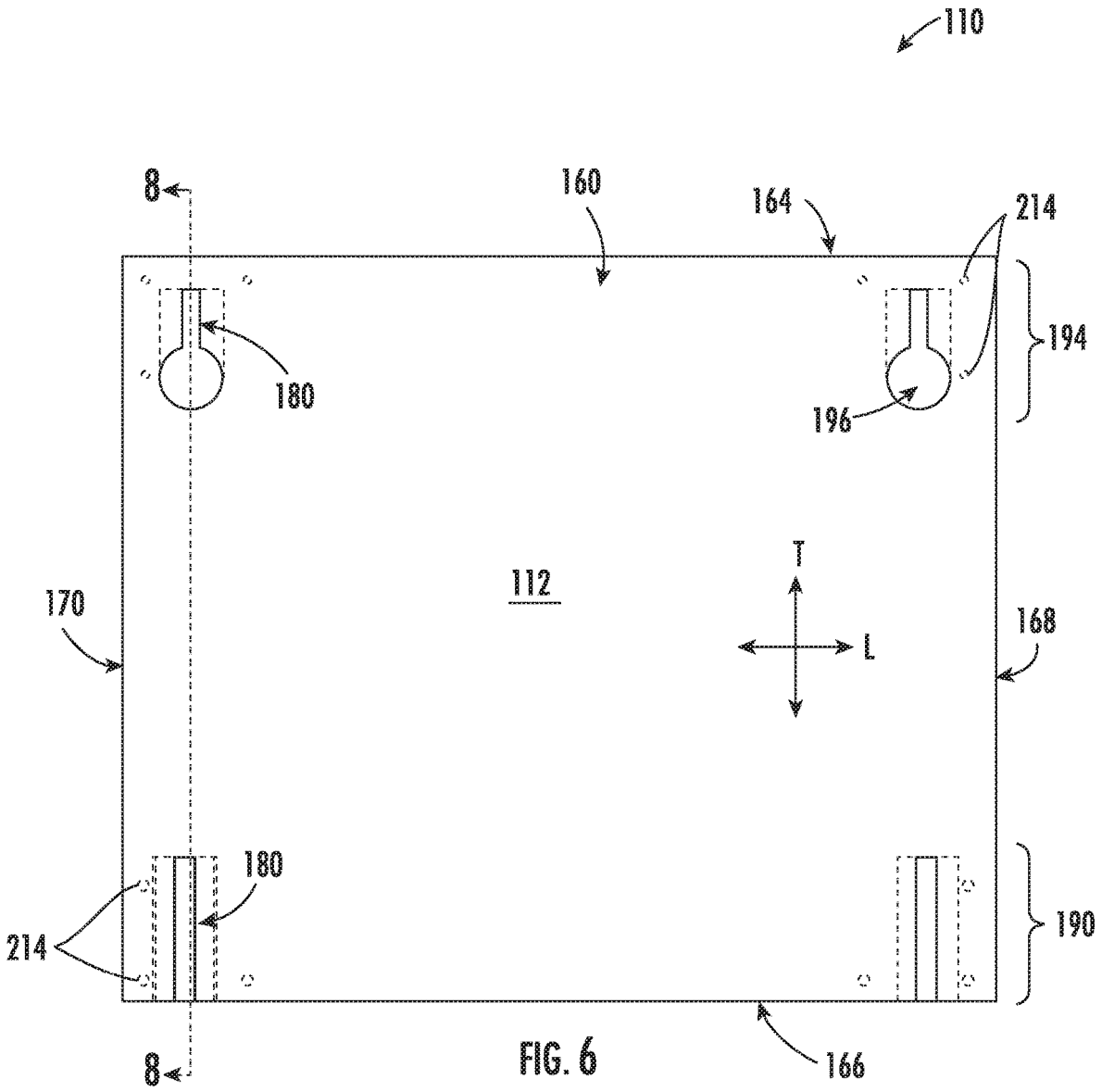
FIG. 6 is a plan view of a top side of the exemplary riser assembly of FIG. 1 according to an exemplary embodiment of the present subject matter.

FIGS. 2 through 4 illustrate front, side, and bottom views, respectively, of dryer appliance 102 according to an exemplary embodiment of the present subject matter. FIG. 5 provides a close up view of leveling legs of dryer appliance 102. Dryer appliance 104 generally defines a vertical direction V, a lateral direction L, and a transverse direction T. The vertical direction V, lateral direction L, and transverse direction T are mutually perpendicular and form an orthogonal direction system.

An apron, housing, or cabinet 120 of dryer appliance 104 extends between a front 122 and a rear 124 along the transverse direction T, between a first side 126 (left side as shown in FIG. 2) and a second side 128 (right side as shown in FIG. 2) along the lateral direction L, and between a bottom 130 and a top 132 along the vertical direction V.

Within cabinet 120 is a container or drum (not shown) which defines a chamber 134 for receipt of articles, e.g., clothing, linen, etc., for drying (or washing in the case of washing machine 102). According to the illustrated embodiment, dryer appliance 104 is a front load appliance, such that the drum and chamber 134 extend between a front portion and a back portion, e.g., along the transverse direction T and are rotatable about an axis that is parallel to the transverse direction T. However, it should be appreciated that according to alternative embodiments, aspects of the present subject matter may be applicable to top load washers and dryers, or to other appliance types, models, and configurations. A door 136 may be rotatably mounted to cabinet 120 for providing selective access to the drum and chamber 134.

As best shown in FIGS. 4 and 5, dryer appliance 104 generally includes a plurality of dryer leveling legs 140. Specifically, dryer 104 may include four dryer leveling legs 140 which are positioned proximate the corners of bottom 130 of cabinet 120. Similarly, as shown in FIG. 1, washing machine 102 may have a set of appliance leveling legs, identified herein as washer leveling legs 142. As described above, dryer leveling legs 140 and washer leveling legs 142 may generally have different sizes, positions, geometries, extension lengths, etc. Although exemplary leveling legs 140, 142 are illustrated herein, it should be appreciated that the number, size, position, and geometries of such legs may vary while remaining within the scope of the present subject matter.

Although dryer leveling legs 140 and washer leveling legs 142 may have different sizes, geometries, etc., the primary components of each leg may remain substantially similar. Thus, like reference numerals may be used herein to refer to the same or similar features on dryer leveling legs 140, washer leveling legs 142, and other leveling legs (e.g., such as those extending from pedestal 112, described below). For simplicity, only the construction dryer leveling legs 140 will be described and illustrated herein. As best shown in FIG. 5, each of dryer leveling legs 140 generally include a shaft 144 that defines a plurality of threads 146 that are received within an aperture 148 defined within bottom 130 of cabinet 120. In addition, a leveling foot 150 or other base is mounted at a distal end of shaft 144 for seating on the ground or within pedestal 112, as described below.

As shown, dryer leveling legs 140 extend substantially along the vertical direction from bottom 130 of cabinet 120. In addition, shaft 144 defines a shaft diameter 152 that is less than a foot diameter 154 of leveling foot 150. Specifically, according to the illustrated embodiment, foot diameter 154 approximately two times the shaft diameter 152. However, according to alternative embodiments, foot diameter 154 may be greater than 1.5 times, greater than 2.5 times, greater than 3.5, or greater, than shaft diameter 152. It should be appreciated that as used herein, terms of approximation, such as "approximately," "substantially," or "about," refer to being within a ten percent margin of error. Dryer leveling legs 140 may further define a length 156 sufficient to facilitate suitable leveling of dryer appliance 104.

Referring now generally to FIGS. 1 and 6 through 11, riser assembly 110 will be described in more detail according to an exemplary embodiment of the present subject matter. In general, riser assembly 110 includes pedestal 112 for raising washing machine 102 and dryer 104. As illustrated, pedestal 112 is a box having a substantially rectangular cross-section that extends between a first side or top side 160 and a second side or bottom side 162 along the vertical direction V. Although the terms "top" and "bottom" are used to refer to sides 160, 162, it should be appreciated that such terminology is only intended to facilitate discussion of the present subject matter, and is not intended to restrict the directional orientation of pedestal 112. In addition, pedestal 112 generally extends between a front side 164 and a rear side 166 along the transverse direction T, and between a left side 168 and right side 170 along the lateral direction L.

According to exemplary embodiments, pedestal 112 may be formed from any material which is sufficiently rigid to support washing machine 102 or dryer 104. For example, pedestal 112 may be formed by injection molding, e.g., using a suitable plastic material, such as injection molding grade high impact polystyrene (HIPS) or acrylonitrile butadiene styrene (ABS). Alternatively, according to the exemplary embodiment, these components may be compression molded, e.g., using sheet molding compound (SMC) thermoset plastic or other thermoplastics. According still other embodiments, pedestal 112 may be formed from metal or any other suitable rigid material, such as sheet metal.

As shown in the figures, pedestal 112 may define a plurality of recesses, slots, indentations, or other features suitable for receiving dryer leveling legs 140 and washer leveling legs 142 for supporting washing machine 102 and dryer 104. Specifically, a first set of receiving pockets 180 may be defined within or by top side 160 of pedestal 112. Generally speaking, the first set of receiving pockets 180 may be sized and positioned such that they have a complementary geometry to washer leveling legs 142. In this manner, first set of receiving pockets 180 are generally configured for receiving washer leveling legs 142 to secure washing machine 102 to pedestal 112. Similarly, on the opposite side of pedestal 112, bottom side 162 defines a second set of receiving pockets 182 that are generally sized and positioned such that they have a complementary geometry to dryer leveling legs 140. In this manner, second set of receiving pockets 182 are generally configured for receiving dryer leveling legs 140 to secure dryer 104 to pedestal 112.

Notably, first set of receiving pockets 180 and second set of receiving pockets 182 have different sizes, shapes, and/or positions, and are positioned on opposite sides of pedestal 112. In this manner, pedestal 112 may be used to receive and support either washing machine 102 or dryer 104 depending on which side 160, 162 is facing up. In other words, pedestal 112 may interchangeably support washing machine 102 or dryer 104.

Figure 9:
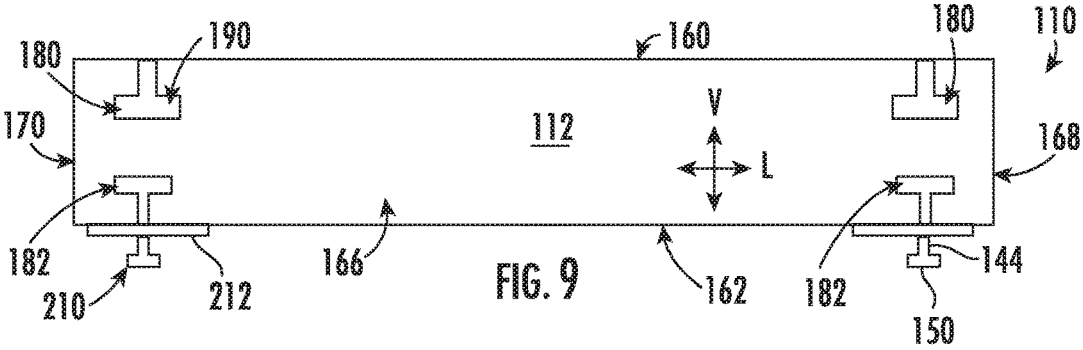
FIG. 9 is a rear view of the exemplary riser assembly of FIG. 1.

As illustrated for example herein and mentioned above, the size, shape, and position of receiving pockets 180, 182 may vary in order to securely receive dryer leveling legs 140 and washer leveling legs 142. In this regard, as best shown in FIG. 9 for example, rear pockets 190 (i.e., those pockets positioned proximate rear side 166 of pedestal 112) of the first set of receiving pockets 180 and the second set of receiving pockets 182 are T-shaped slots that extend along the transverse direction T and open through a rear side 166 of pedestal 112. In this manner, rear legs 192 (i.e., those legs positioned proximate rear 124 of cabinet 120) of the set of washer leveling legs 142 or the set of dryer leveling legs 140 may slide into pedestal 112 from rear side 166 of pedestal 112.

By contrast, front pockets 194 (i.e., those pockets positioned proximate front side 164 of pedestal 112) of the first set of receiving pockets 180 and the second set of receiving pockets 182 each include a vertical receiving hole 196 and a T-shaped slot extending along the transverse direction T from a bottom of the vertical receiving hole 196 such that front legs 198 (i.e., those legs positioned proximate front 122 of cabinet 120) of the set of washer leveling legs 142 or the set of dryer leveling legs 140 may drop into the receiving hole 196 before sliding forward into the T-shaped slot.

Figure 10:
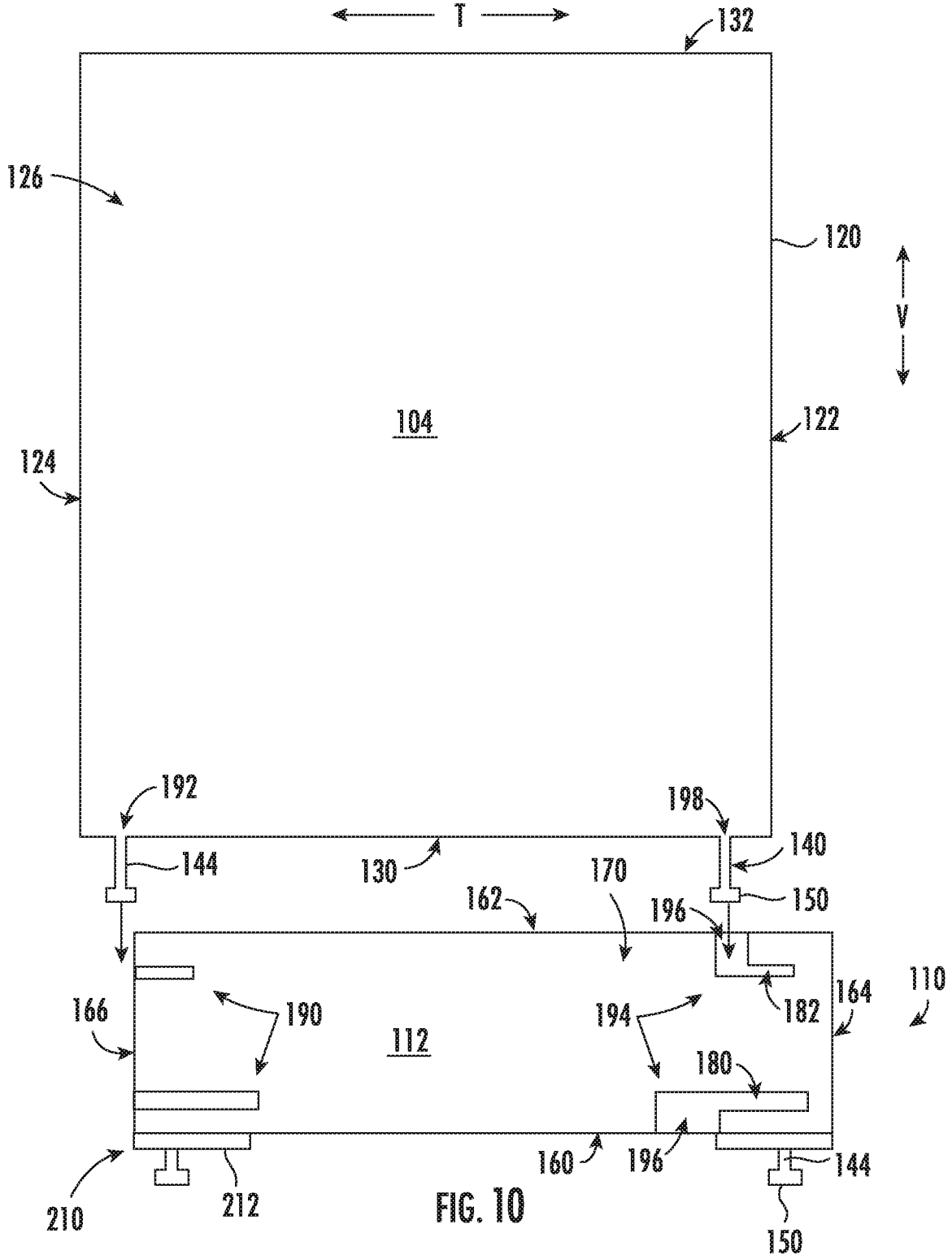
FIG. 10 is a schematic view of a set of leveling legs of an appliance being received within a set of receiving pockets of the exemplary riser assembly of FIG. 1 according to an exemplary embodiment of the present subject matter.
Figure 11:
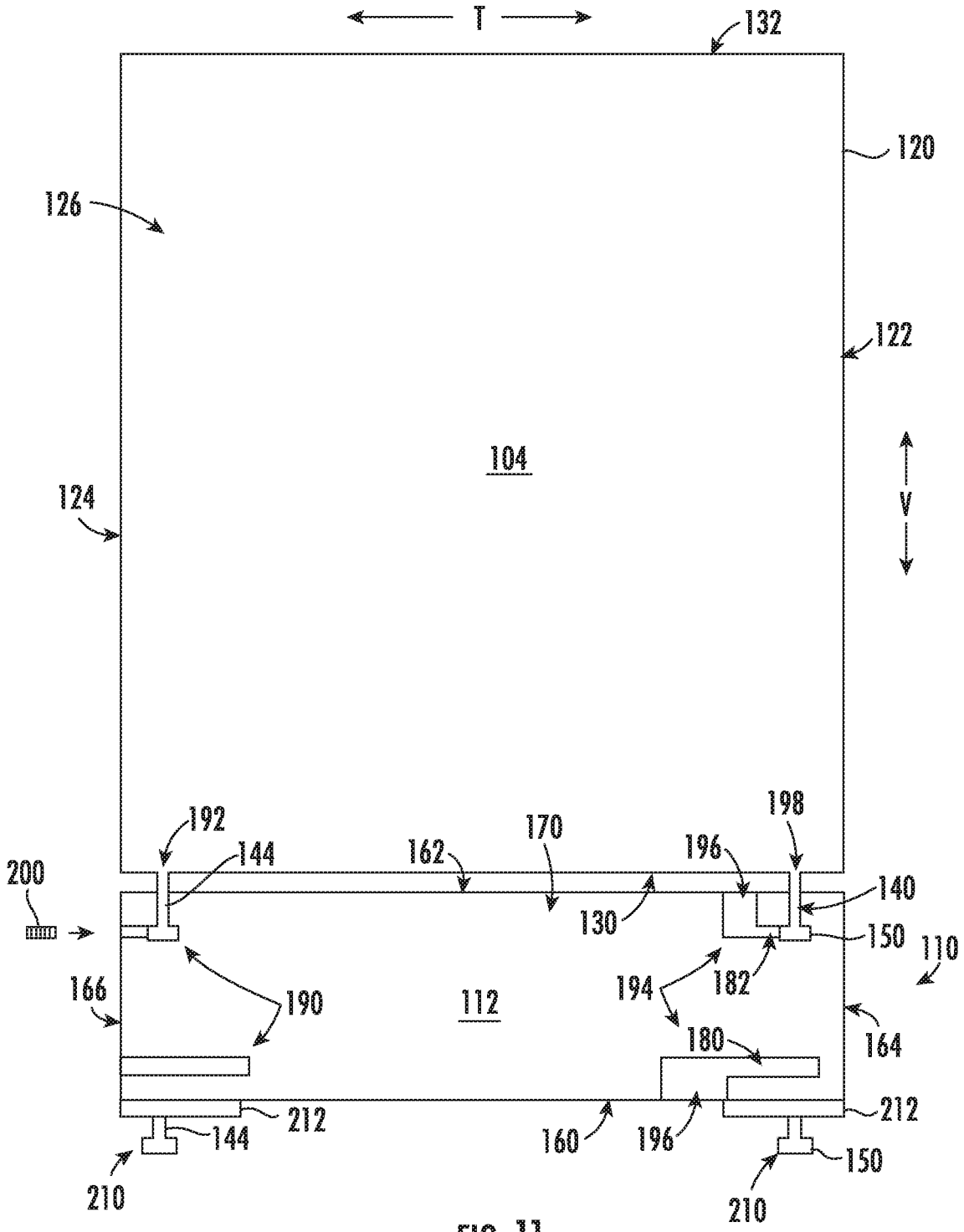
FIG. 11 is a schematic view of a locking pin securing the set of leveling legs within the set of receiving pockets of the exemplary riser assembly of FIG. 1 according to an exemplary embodiment of the present subject matter.

Referring now to FIGS. 10 and 11, the installation of dryer appliance 104 and into second set of receiving pockets 182 will be described. As shown, vertical receiving hole 196 has a diameter sufficient for receiving leveling foot 150 of front legs 198. Thus, during installation, a user will set front legs 198 into vertical receiving hole 196 and will align leveling feet 150 of rear legs 192 with rear pockets 190. A user will then push forward on dryer 104 to slide front legs 198 into the T-shaped slot defined by front pockets 194. Simultaneously, rear legs 192 will slide into rear pockets 190. Although an exemplary configuration of receiving pockets 180, 182 is described herein, it should be appreciated that these pockets may vary while remaining within scope of the present subject matter. For example, all receiving pockets 180, 182 could alternatively be formed with a vertical receiving hole similar to front pockets 194. Alternatively, pedestal 112 could define a single elongated T-shaped slot that extends along the transverse direction T from rear side 166 to a location proximate a front side 164 of pedestal 112, such that dryer 104 is installed by sliding both front legs 198 and rear legs 192 through the opening in the rear side 166 until dryer 104 is properly seated on pedestal 112.

Referring specifically to FIG. 11, riser assembly 110 may further include features for locking dryer 104 in place after it is installed onto pedestal 112. For example, according to the illustrated embodiment, riser assembly 110 includes a locking pin 200 that engages at least one of the first set of receiving pockets 180 and the second set of receiving pockets 182 for retaining dryer leveling legs 140 when installed. Although a threaded screw stud is illustrated in FIG. 11, it should be appreciated that locking pin 200 could be replaced with a snap-fit mechanism, a locking screw, a rear plate, or any other suitable securing feature or mechanism.

Referring again generally to FIGS. 1 and 6 through 11, riser assembly 110 includes a plurality of riser leveling legs 210 that are mountable to both top side 160 and bottom side 162 of pedestal 112. In general, riser leveling legs 210 may be any suitable foot or leveling feature that may be mounted on either side of pedestal 112 for supporting both pedestal 112 and the appliance mounted thereon. Notably, riser leveling legs 210 are generally interchangeable, such that they may be used on either side of pedestal 112 and require the same mounting procedure and hardware. Although exemplary riser leveling legs 210 are described below, it should be appreciated that such legs may vary while remaining within the scope of the present subject matter.

According to the illustrated embodiment, riser assembly 110 further includes a plurality of riser brackets 212 that are mountable to either top side 160 or bottom side 162 of pedestal 112, wherein such brackets 212 are configured for receiving the plurality of riser leveling legs 210. As shown, pedestal 112 may define fastener holes 214 for receiving the plurality of riser brackets 212 at the same position on both sides of pedestal 112. Specifically, fastener holes 214 are positioned at the same X-Y coordinates (or L-T coordinates) on both sides of pedestal 112. In this manner, triangular riser brackets 212 may be mounted with one or more fasteners (not shown) on the side of pedestal 112 opposite of the mounted appliance.

Figure 7:
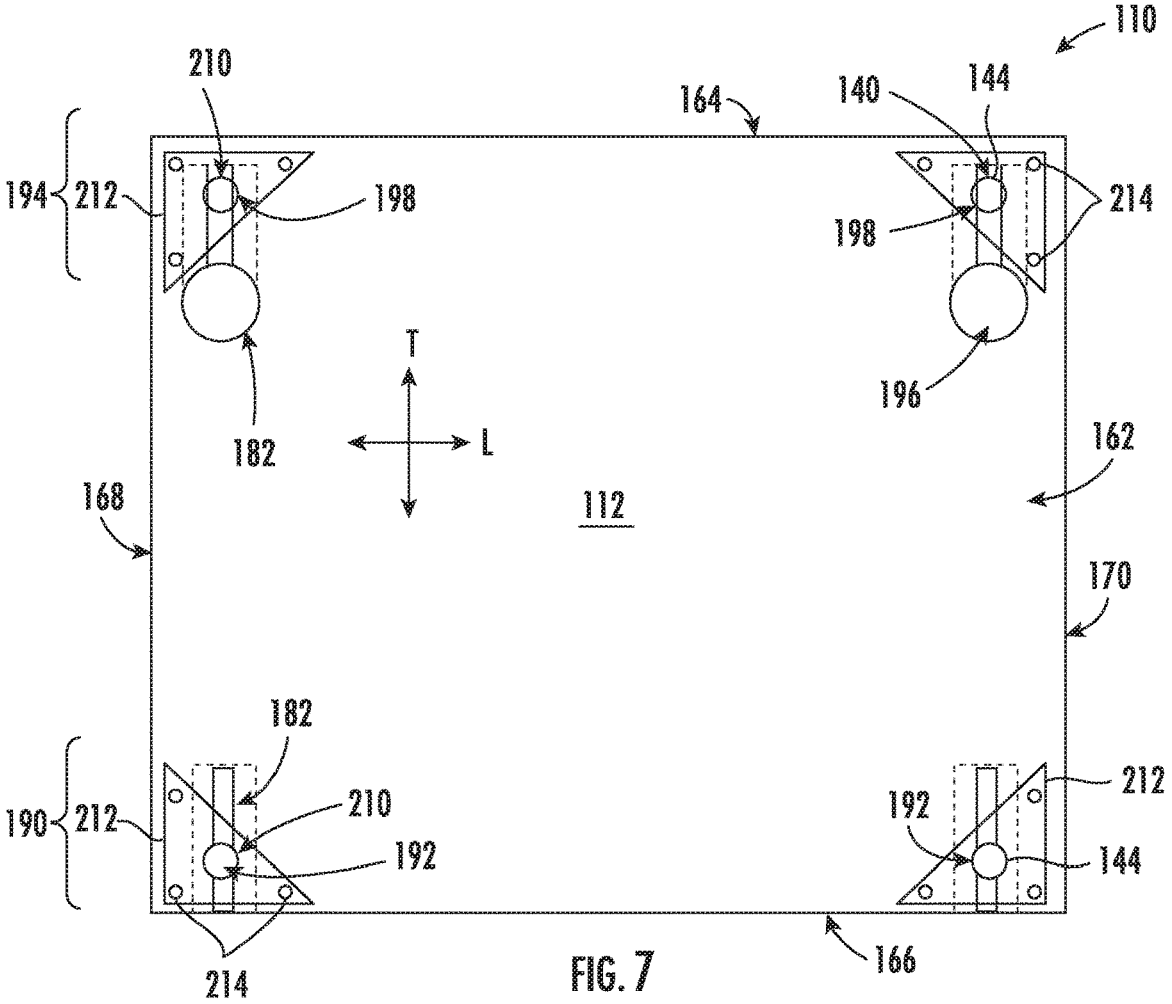
FIG. 7 is a plan view of a bottom side of the exemplary riser assembly of FIG. 1 according to an exemplary embodiment of the present subject matter.
Figure 8:
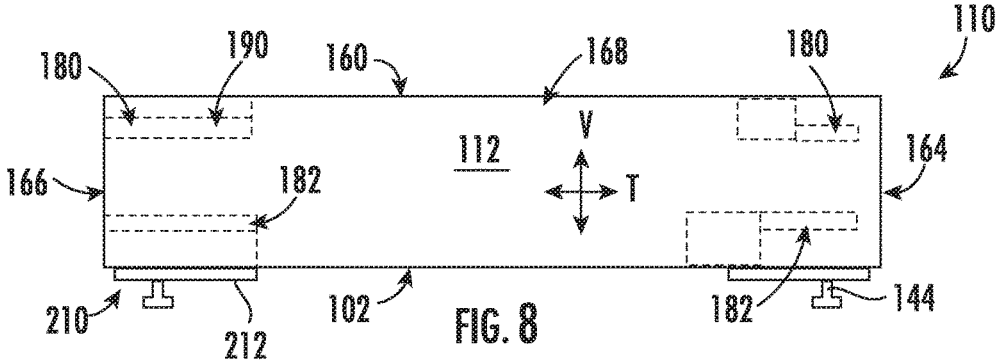
FIG. 8 is a cross sectional view of the exemplary riser assembly of FIG. 1, taken along Line 8-8 of FIG. 6.

Similar to leveling feet 140, 142, riser leveling legs 210 may generally define a threaded shaft 144 that includes threads 146 that are received within a threaded aperture 148 defined within riser brackets 212. In addition, a leveling foot 150 may be mounted on a distal end of each shaft 144. In this manner, riser leveling legs 210 may be used to raise or lower pedestal 112 at each riser bracket 212 to properly balance, raise, or lower pedestal 112 and the appliance mounted thereon. In addition, as shown in FIG. 7, riser brackets 212 may be mounted such that riser leveling legs 210, or more specifically shafts 144 are positioned over one of the first or second sets of receiving pockets 180, 182. In this manner, as riser leveling leg is recessed to lower pedestal 112, shaft 144 may pass into the receiving pockets 180, 182 without bottoming out or otherwise contacting pedestal 112 and preventing further movement of riser leveling leg 210.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A riser assembly for receiving a washing machine or a dryer, the riser assembly comprising:

a pedestal having a top side defining a first set of receiving pockets configured for receiving a set of washer leveling legs and an opposite bottom side defining a second set of receiving pockets configured for receiving a set of dryer leveling legs; and a plurality of riser leveling legs mountable to both the top side and the bottom side of the pedestal.

2. The riser assembly of claim 1, wherein the first set of receiving pockets have a different size or shape than the second set of receiving pockets.

3. The riser assembly of claim 1, further comprising:

a plurality of riser brackets mountable to the top side and the bottom side of the pedestal, wherein the plurality of riser brackets are configured for receiving the plurality of riser leveling legs.

4. The riser assembly of claim 3, wherein each of the plurality of riser leveling legs comprises a leveling foot mounted to a distal end of a threaded shaft and each of the plurality of riser brackets defines a threaded aperture for receiving the threaded shaft of one of the plurality of riser leveling legs.

5. The riser assembly of claim 4, wherein the each of the plurality of riser leveling legs is mounted over either the first set of receiving pockets or the second set of receiving pockets such that the threaded shaft may recess therein.

6. The riser assembly of claim 3, wherein the pedestal defines fastener holes for receiving the plurality of riser brackets at the same positions on both the top side and the bottom side of the pedestal.

7. The riser assembly of claim 1, wherein rear pockets of the first set of receiving pockets and the second set of receiving pockets are T-shaped slots that extend along a transverse direction and open through a side of the pedestal such that rear legs of the set of washer leveling legs or the set of dryer leveling legs may slide into the pedestal from the side of the pedestal.

8. The riser assembly of claim 1, wherein front pockets of the first set of receiving pockets and the second set of receiving pockets each include a vertical receiving hole and a T-shaped slot extending along the transverse direction from a bottom of the vertical receiving hole such that front legs of the set of washer leveling legs or the set of dryer leveling legs may drop into the receiving hole before sliding forward into the T-shaped slot.

9. The riser assembly of claim 1, further comprising:

a locking pin that engages at least one of the first set of receiving pockets and the second set of receiving pockets for retaining the set of washer leveling legs or the set of dryer leveling legs when installed.

10. The riser assembly of claim 1, wherein the set of washer leveling legs are located at different positions on the bottom of the washer cabinet than the set of dryer leveling legs on the bottom of the dryer cabinet.

11. The riser assembly of claim 1, wherein the set of washer leveling legs have a different size or shape than the set of dryer leveling legs.

12. The riser assembly of claim 1, wherein the pedestal is injection molded using plastic.

13. A laundry appliance system comprising:

a washing machine comprising a washer cabinet and set of washer leveling legs extending from a bottom of the washer cabinet;

a dryer comprising a dryer cabinet and a set of dryer leveling legs extending from a bottom of the dryer cabinet; and a riser assembly for receiving the washing machine or the dryer, the riser assembly comprising:

a pedestal having a top side defining a first set of receiving pockets configured for receiving the set of washer leveling legs and an opposite bottom side defining a second set of receiving pockets configured for receiving the set of dryer leveling legs.

14. The laundry appliance system of claim 13, wherein the riser assembly further comprises:

a plurality of riser leveling legs, each of the plurality of riser leveling legs comprising a leveling foot mounted to a distal end of a threaded shaft; and a plurality of riser brackets mountable to the top side and the bottom side of the pedestal, each of the plurality of riser brackets defining a threaded aperture for receiving the threaded shaft of one of the plurality of riser leveling legs.

15. The laundry appliance system of claim 14, wherein the each of the plurality of riser leveling legs is mounted over either the first set of receiving pockets or the second set of receiving pockets such that the threaded shaft may recess therein.

16. The laundry appliance system of claim 14, wherein the pedestal defines fastener holes for receiving the plurality of riser brackets at the same positions on both the top side and the bottom side of the pedestal.

17. The laundry appliance system of claim 13, wherein rear pockets of the first set of receiving pockets and the second set of receiving pockets are T-shaped slots that extend along a transverse direction and open through a side of the pedestal such that rear legs of the set of washer leveling legs or the set of dryer leveling legs may slide into the pedestal from the side of the pedestal.

18. The laundry appliance system of claim 13, wherein front pockets of the first set of receiving pockets and the second set of receiving pockets each include a vertical receiving hole and a T-shaped slot extending along the transverse direction from a bottom of the vertical receiving hole such that front legs of the set of washer leveling legs or the set of dryer leveling legs may drop into the receiving hole before sliding forward into the T-shaped slot.

19. The laundry appliance system of claim 13, wherein the riser assembly further comprises:

a locking pin that engages at least one of the first set of receiving pockets and the second set of receiving pockets for retaining the set of washer leveling legs or the set of dryer leveling legs when installed.

20. A riser assembly for receiving a washing machine or a dryer, the riser assembly comprising:

a pedestal having a top side defining a first set of receiving pockets configured for receiving a set of washer leveling legs and an opposite bottom side defining a second set of receiving pockets configured for receiving a set of dryer leveling legs, wherein the set of washer leveling legs are located at different positions on the bottom of the washer cabinet than the set of dryer leveling legs on the bottom of the dryer cabinet.

* * * * *